United States Patent [19]

Hui-Lai

[11] 4,311,243

[45] Jan. 19, 1982

[54] ASSEMBLING MEMBERS

[76] Inventor: Chen Hui-Lai, No. 2, Lane 38, Shungchian Rd., Taipei, Taiwan

[21] Appl. No.: 145,268

[22] Filed: Apr. 25, 1980

[51] Int. Cl.[3] ..... A47J 51/00; A47F 13/00

[52] U.S. Cl. ..... 211/113; 211/13; 211/90; 211/119.01; 248/317

[58] Field of Search ..... 211/13, 87, 90, 113, 211/118, 119.01; 182/150; 248/317, 201, 58

[56] References Cited

U.S. PATENT DOCUMENTS

| | | | |
|---|---|---|---|
| 1,738,030 | 12/1929 | Bebb | 211/118 |
| 1,914,967 | 6/1933 | Bebb | 211/113 |
| 2,486,035 | 10/1949 | Koester | 211/118 |
| 2,972,419 | 2/1961 | Zelen | 211/113 |
| 3,851,729 | 12/1974 | Gordon | 182/150 |
| 3,945,462 | 3/1976 | Griswold | 182/150 |

*Primary Examiner*—Reinaldo P. Machado
*Attorney, Agent, or Firm*—Browdy and Neimark

[57] ABSTRACT

A set of assembling members for constructing a supporting device primarily comprises at least two substantially hollow quadrilateral brackets having a plurality of openings on its sides and traversed protrusions provided correspondingly on a pair of opposed sides thereof each protrusion having a through way therein; at least two chains composed of several substantially S-shaped members for mounting on the brackets; bars for inserting through the through way of the brackets; rectangular plates having four slots provided at the corners thereof for receiving the opposed sides of the bracket; and positioning plates having a number of traversed parallel openings therein for engaging with the S-shaped members so as to space two chains which are mounted on the bracket. The supporting device assembled by the assembling members can be mounted on the wall, ceiling or ground for supporting and positioning different kinds of articles.

7 Claims, 10 Drawing Figures

91
90
91

82
81
82

21
25
20
22
22
24
23

80

51c
51b
50
51a 11a
11b
15a
11b
10
14b
14a
13
121
12
15b 17 11b
11a 71
70

60
31
31
30

41
40

ASSEMBLING MEMBERS

BACKGROUND OF THE INVENTION

This invention relates to a set of assembling members which is particularly, but not exclusively used to construct supporting device suitable to be mounted on the ceiling or wall for supporting and positioning different kinds of articles.

Many known types of supporting devices have been developed in the art, but most of them stand on the ground and reduce the efficient space in a room. Furthermore, each of the conventional supporting devices performs generally only a simple function, that is to say, it is just suitable for positioning or supporting a kind of thing, for instances, clothing racks may not be available for hanging hats, and wall brackets can not act as ceiling brackets. The most known clothing supporting device, which is generally mounted on walls of balcony of an apartment or on objects placed in the back yard, has two supporting members for supporting a longitudinal bar. As there is not any positioning means on the longitudinal bar, the clothes hanging on the longitudinal bar are very easily staggered each other or blown down to the ground by wind, therefore, a lot of people are not satisfied with the most known supporting device. Additionally, the length and height of these above-described conventional supporting devices are not variable by adding or subtracting the assembling members thereof so that the scope of their use is relatively limited.

SUMMARY OF THE INVENTION

In accordance with the present invention a set of assembling members primarily comprises at least two substantially hollow quadrilateral brackets having a plurality of openings provided on the sides thereof and traversed corresponding protrusions provided on a pair of opposed sides thereof each protrusion having a through way therein; at least two chains composed of several substantially S-shaped members; hanging devices each having a loop portion to be supported on a lower side of the hollow quadrilateral brackets, two parallel arms extending integrally from the loop portion and each having a hook end, and a movable elastic fastener for fastening the parallel arms together, the loop portion being provided with an inward positioning pin for inserting through one of the openings provided on the lower sides of the bracket when the hanging device is hung on the bracket; positioning plates having a number of parallel traversed openings therein for engaging with the chains so as to space two said chains mounted on the hollow quadrilateral brackets and to permit objects to be put or hung on it; longitudinal rectangular plates having four slots provided respectively on the corner portions thereof for receiving the opposed sides of the brackets; a number of first and second bar members being able to extend through the through way of the protrusions, the second bar members having external screws provided on ends thereof; supporting rods capable of extending through the through way of the brackets having annular grooves there; screw members for inserting into a radial through hole provided on the protrusions and intersecting with the through way of the protrusion to fix the first bar member, second bar member or the supporting rod received within the through way; and positioning strips having openings therein for receiving the second bar members.

Accordingly, it is an object of the present invention to provide a set of assembling members which can be assembled to form a multi-functional supporting device for supporting and positioning different kinds of articles.

Another object of the present invention is to provide a set of assembling members which is used to assemble a multi-functional supporting device to be mounted on the wall or ceiling.

A further object of the present invention is to provide a set of assembling members for constructing a multi-functional supporting device which provides a large capacity so as to support and position many things thereon whilst occupies little space.

Still a further object of the present invention is to provide a set of assembling members for constructing a multi-functional supporting device which is particularly suitable for a small room.

An additional object of the present invention is to provide a set of assembling members for constructing a multi-functional supporting device which can also be positioned on the ground.

An even further object of the present invention is to provide a set of assembling members for constructing a multi-functional supporting device which can be suitably mounted on the walls of the balcony of the apartment without affecting the pleasant appearance of the building.

Other and further objects of this invention will become obvious upon one's understanding the illustrative embodiments to be described hereinafter or indicated in the appended claims, and various advantages not referred to herein will occur to those skilled in the art.

DETAILED DESCRIPTION OF A PREFERRED EMBODIMENT

Figures 1A, 1B, 1C, 1D, 1E, 1F, 1G, 1H, 1I:
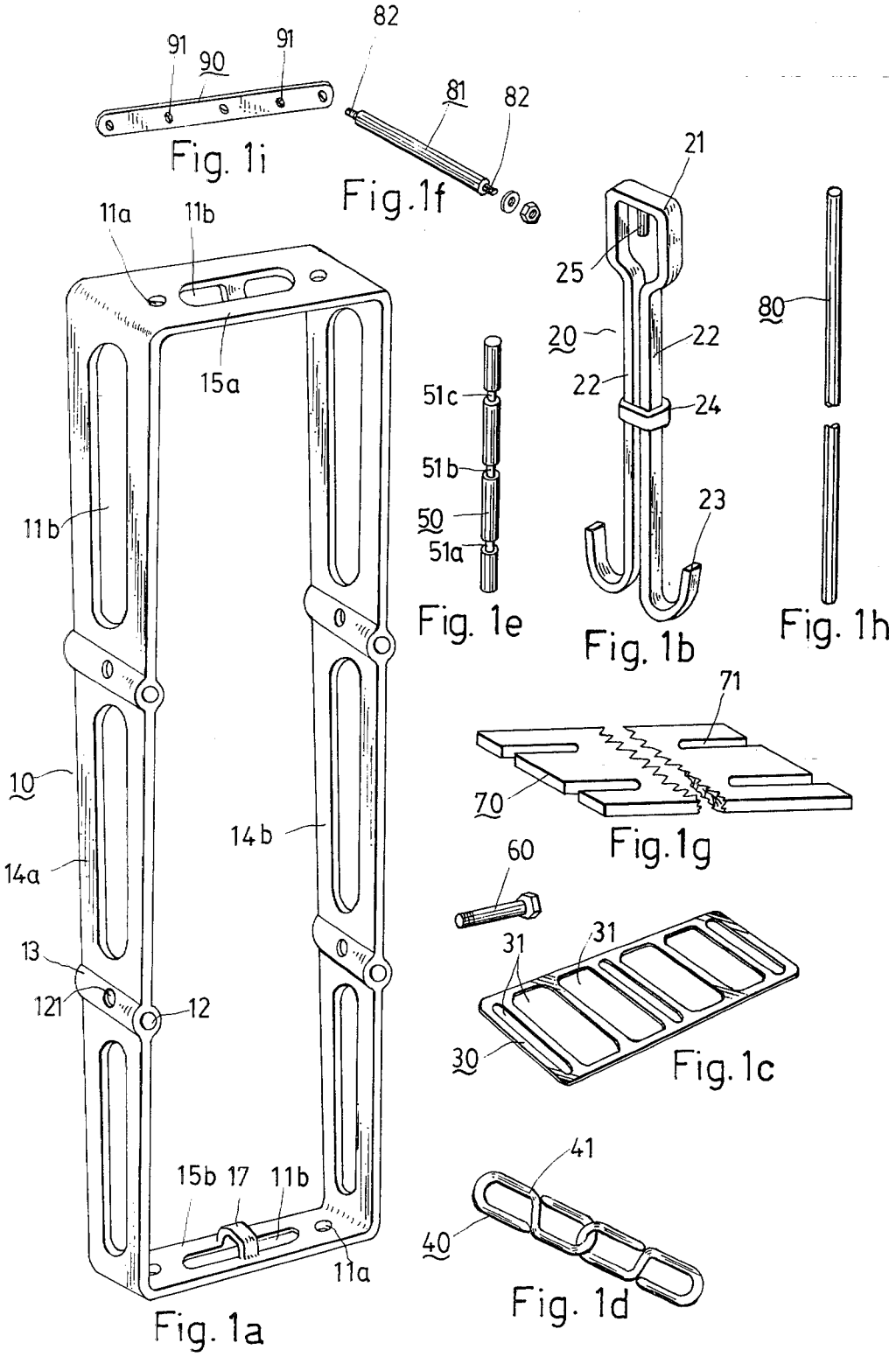
FIG. 1*a* is a perspective view of hollow rectangular bracket according to the invention.
FIG. 1*b* is a perspective view of a hanging device according to the invention.
FIG. 1*c* is a perspective view of a positioning plate according to the invention.
FIG. 1*d* is a perspective view of a chain according to the invention.
FIG. 1*e* is a perspective view of a supporting rod according to the invention.
FIG. 1*f* is a perspective view of a second bar member according to the invention.
FIG. 1*g* is a perspective view of a rectangular plate according to the present invention.
FIG. 1*h* is a perspective view of a first bar member according to the invention.
FIG. 1*i* is a perspective view of positioning strip according to the invention.

Referring now to the drawings, FIG. 1*a* shows a perspective view of a hollow rectangular bracket 10 having a plurality of longitudinal openings 11*b* provided on the sides thereof, corresponding traversed protrusions 13 each having through way 12 therein and provided on a pair of opposed long sides 14*a*, 14*b* thereof, and circular openings 11*a* provided on the other pair of opposed short side thereof. The hollow rectangular bracket 10 is made of metal materials such as cast iron or aluminum alloy, of course, it can also be made of injecting plastics. Through circular openings 11*a* of the upper short side a screw of any fastening member can be screwed into or connected with the wall or ceiling of a building so as to mount fixedly the hollow rectangular bracket 10 on the wall or the ceiling. The protrusions 13 have preferrably a cylindrical configuration for enhancing the strength of the bracket 10, supporting a plate 70 (as shown in FIG. 1*g*) thereon and receiving a first or second bar member 80 or 81 (as shown in FIG. 1*h* or 1*f*). The second bar member 81 has external screw 82 provided on the end portion thereof or a supporting rod 50 (as shown in FIG. 1*e*) within the through way thereof. The through ways 12 of the opposed long sides 14*a*, 14*b* of the bracket 10 are kept on the same level so that they may position the plate 70 in a horizontal condition between two adjacent longitudinal openings 11*b*. Opposed short sides 15*a*, 15*b* of the bracket 10 are provided with an inward protrusion 17 having an opening therein for engaging with a chain 40 as shown in FIG. 1*d* or other hanging members not shown in the drawings. The protrusion 17 is preferrably located on the middle portion of the longitudinal opening provided on the opposed short sides 15*a*, 15*b*. The width of the opposed long sides 14*a*, 14*b* of the bracket 10 preferrably increase gradually from the lower end to the upper end thereof so as to enhance the strength of the bracket 10.

FIG. 1*b* shows a hanging device 20 in accordance with the present invention having a loop portion 21, two parallel arms 22 extending integrally from the loop portion 21 and having a hook end 23, and a movable elastic fastener 24. Width of the loop portion is preferrably equal to or larger than that of the lower short side 15*b* of the bracket 10 so that the hanging device 20 may be on the bracket 10. After the hanging device 20 is mounted on the bracket, the fastener is then fastened on the parallel arms 22 for enhancing the strength of the loop portion of the hanging device. Provided on the central of the loop portion 21 is an inward positioning pin 25 capable of extending through one of the circular openings 11*a* provided on the lower short side 15*b* of the bracket 10 for positioning purpose.

Figure 2:
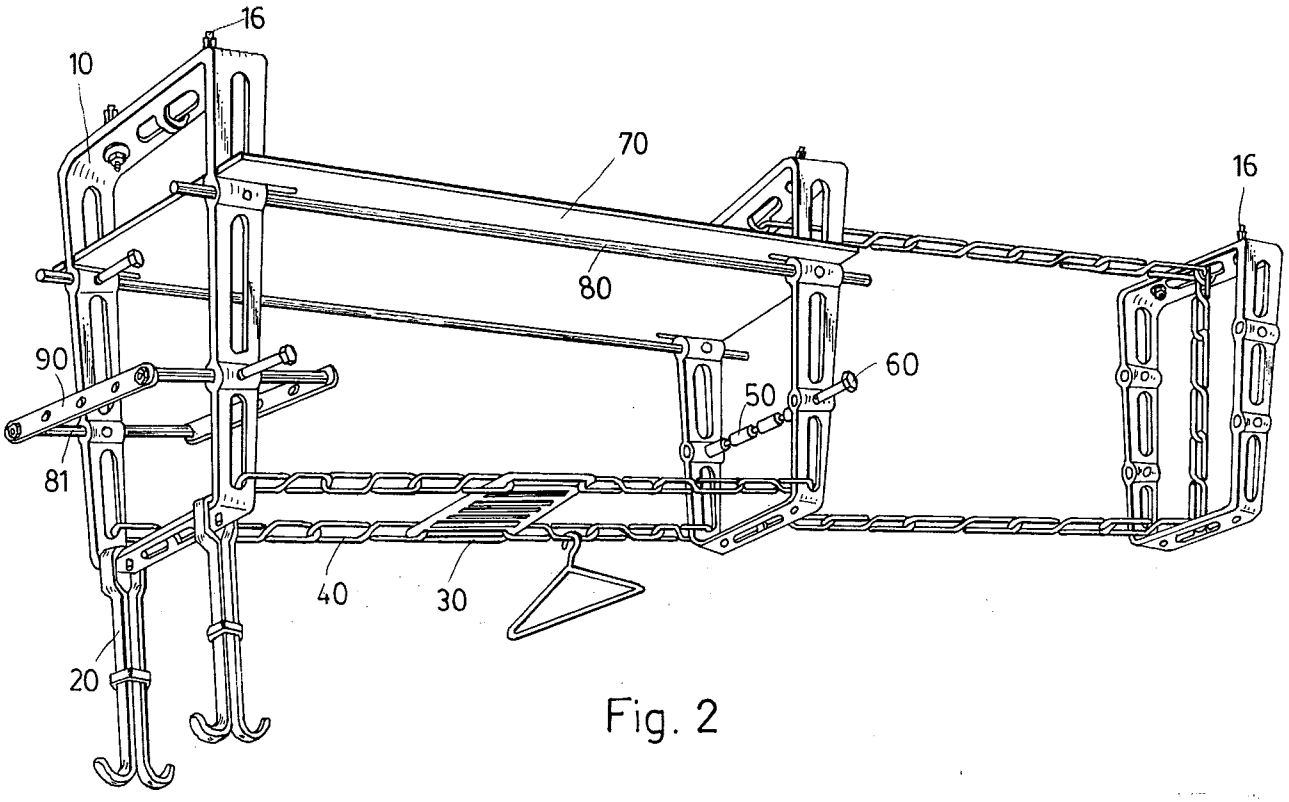
FIG. 2 is a perspective view of a supporting device assembled by the members shown in FIGS. 1*a* to 1*h*.

FIGS. 1*c* and 1*d* show a positioning plate 30 and a chain 40 respectively. The chain 40 is preferrably made of plastics and composed of several S-shaped members so that ends of the chain 40 can be opened to allow it to insert into and engage with the longitudinal opening 11*b* or the protrusion 17 of the bracket 10. The positioning plate 30 has a number of traversed parallel openings 31 therein through which ends of the S-shaped member 41 can be connected therewith. The positioning plate 30 can hold two parallel chains 40 mounted on the bracket 10 in a spaced relation as shown in FIG. 2. On the other hand, the plate 30 positioned by the S-shaped members 41 is suitable for carrying something thereon. The width of the positioning plate 30 is approximately integral times of the length of the S-shaped member 41.

FIG. 1*e* shows the supporting rod 50 having three annular grooves 51*a*, 51*b* and 51*c*. The diameter of the supporting rod 50 is slightly smaller than the inner diameter of the through way 121 so as to permit the rod 50 to insert through the through way. At least one of the annular grooves 51*a*, 51*b* and 51*c* provided on the supporting rod 50 can protrude out of the through way 12 when the rod 50 is received within the through way. To secure the supporting rod 50 in the through way 12 a screw 60 may be screwed into a radial through hole 121 provided in the protrusion 12 to contact tightly with the rod. The through hole 121 has female screw therein for engaging with the screw 60. The diameter of the through hole 121 is preferrably equal to that of the through way 12 so that the supporting rod 50 may extend through the through hole 121 and fixed by screws 60 as shown in FIG. 2.

FIG. 1*g* shows the rectangular plate 70 having four longitudinal slots 71 provided at the conners thereof for receiving the opposed long sides 14*a*, 14*b* of the bracket 10 so that the rectangular plate 70 can be supported in a horizontal position by the corresponding protrusions 12 of the two brackets 10 as shown in FIG. 2.

FIG. 1*i* shows a positioning strip 90 having a plurality of openings 91 through which the screwed end 82 of the second bar member 81 can be extended and locked by nut.

Referring to FIG. 2 there is shown a supporting device assembled by the above-described assembling members according to the invention, in which three hollow rectangular brackets 10 are mounted on the ceiling (not shown) by bolts 16.

It is to be understood that the chains 40 can also be arranged in an intercrossed relationship or in an inclined situation other than the parallel horizontal or the vertical position as shown in FIG. 2.

It is to be understood that one through way 12 of the bracket 10 can also receive simultaneously one end of two first bar members 80 as that the supporting device may extend unlimitedly in the longitudinal direction to meet the actual need.

While there has been described a preferred form of the invention, obviously modifications and variations are possible in the light of the above teachings. It is therefore to be understood that within the scope of the appended claims, the invention may be practiced otherwise than as specifically described.

What is claimed is:

1. A set of assembling members for constructing a supporting device comprises:

at least two substantially hollow quadrilateral brackets having a plurality of openings provided on the sides thereof, and traversed protrusions provided correspondingly on a pair of opposed sides thereof each protrusion having a through way therein;

at least two chains composed of a number of substantially S-shaped members to engage with the longitudinal openings of said hollow rectangular brackets; positioning plates having parallel traversed openings therein for engaging with said chains so as to space at least two said chains mounted in parallel on said brackets;

first bar members for extending through corresponding through ways of said brackets; and plates having four longitudinal slots located at corner portions thereof respectively for receiving the opposed sides of said brackets so as to allow said plates to be supported on said protrusions.

2. A set of assembling members for constructing a suppotting device as claimed in claim 1 further comprises hanging members having a loop portion to be supported on a lower side of said brackets, two parallel arms each having a hook end, and a movable elastic fastener for fastening said arms after said hanging members being mounted on the lower side of said brackets, wherein an inward extending positioning pin is integrally provided on said loop portion to extend through one of said openings of the lower side when said hanging member is hung on the lower side of said bracket.

3. A set of assembling members for constructing a supporting device as claimed in claim 1 further comprises a number of supporting rods having annular grooves, said supporting rods being able to extend through said through ways of said brackets.

4. A set of assembling members for constructing a supporting device as claimed in claim 1, wherein said protrusions are provided with a radial through hole having female screw therein for engaging with a screw to contact tightly with said first bar member or said supporting rod received in said through way so as to avoid the slipping of said bar member of said supporting rod.

5. A set of assembling members for constructing a supporting device as claimed in claim 4, wherein the diameter of said through hole is preferrably equal to that of said through way so as to permit said bar member or said supporting rod extending therethrough.

6. A set of assembling members for constructing a supporting device as claimed in any one of the preceding claims wherein a pair of opposed sides of said brackets are provided with an inward protrusion having an opening therein for engaging with said chains.

7. A set of assembling members for constructing a supporting device as claimed in claim 6 wherein the width of a pair of opposed sides of said bracket gradually increases from the lower end to the upper end thereof.

* * * * *